US008322375B2

(12) United States Patent
Helbling et al.

(10) Patent No.: US 8,322,375 B2
(45) Date of Patent: Dec. 4, 2012

(54) CONTROL DEVICE AND HYDRAULIC PILOT CONTROL

(75) Inventors: Frank Helbling, Sasbach (DE); Günter Fertig, Wertheim (DE); Albrecht Kessler, Gössenheim (DE); Josef Hessdörfer, Retzbach (DE); Burkhard Knöll, Burgsinn (DE)

(73) Assignees: Robert Bosch GmbH, Stuttgart (DE); Liebherr France SAS, Colmar Cedex (FR)

( * ) Notice: Subject to any disclaimer, the term of this patent is extended or adjusted under 35 U.S.C. 154(b) by 958 days.

(21) Appl. No.: 12/224,106

(22) PCT Filed: Feb. 16, 2007

(86) PCT No.: PCT/EP2007/001373

§ 371 (c)(1),
(2), (4) Date: Aug. 18, 2008

(87) PCT Pub. No.: WO2007/096099

PCT Pub. Date: Aug. 30, 2007

(65) Prior Publication Data

US 2009/0044872 A1 Feb. 19, 2009

(30) Foreign Application Priority Data

Feb. 21, 2006 (DE) ..... 10 2006 007 935

(51) Int. Cl.
*F15B 13/043* (2006.01)

(52) U.S. Cl. ..... 137/625.62; 127/625.66

(58) Field of Classification Search ..... 137/625.66, 137/625.6, 625.64, 625.62, 625.65
See application file for complete search history.

(56) References Cited

U.S. PATENT DOCUMENTS

| | | | | |
|---|---|---|---|---|
| 3,599,675 | A * | 8/1971 | Sievenpiper | 137/636.1 |
| 4,126,293 | A * | 11/1978 | Zeuner et al. | 137/625.64 |
| 4,220,074 | A * | 9/1980 | Reip | 137/625.64 |
| 4,627,468 | A * | 12/1986 | Wilke et al. | 137/625.66 |
| 4,799,420 | A * | 1/1989 | Budzich | 91/529 |
| 4,830,050 | A * | 5/1989 | Sekikawa | 137/599.16 |
| 4,833,798 | A * | 5/1989 | Ehrich | 137/625.6 |
| 5,056,561 | A * | 10/1991 | Byers | 137/625.64 |
| 5,315,828 | A * | 5/1994 | Stellwagen et al. | 60/426 |
| 5,546,847 | A * | 8/1996 | Rector et al. | 91/403 |
| 5,613,519 | A * | 3/1997 | Ishizaki | 137/596.2 |
| 5,632,306 | A * | 5/1997 | Taka | 137/625.64 |
| 5,806,565 | A * | 9/1998 | Kadlicko | 137/625.63 |
| 5,832,808 | A * | 11/1998 | Ishizaki et al. | 137/625.66 |
| 6,516,614 | B1 * | 2/2003 | Knoll | 60/327 |
| 2006/0201146 | A1 * | 9/2006 | Tabor | 60/413 |

FOREIGN PATENT DOCUMENTS

DE 41 37 963 5/1993

(Continued)

*Primary Examiner* — Craig Schneider
*Assistant Examiner* — Seth Faulb
(74) *Attorney, Agent, or Firm* — Dilworth & NBarrese, LLP.

(57) ABSTRACT

A control device for controlling a hydraulic consumer, is equipped with a distributing valve having a control pressure chamber and a control slide that can be displaced against the force of a spring by the build-up of a control pressure in the control pressure chamber. A pilot control valve controls the supply and discharge of control fluid into and out of the control pressure chamber. A release device is used to drive the control fluid out of the control pressure chamber, bypassing the pilot control valve.

13 Claims, 4 Drawing Sheets

FOREIGN PATENT DOCUMENTS

| | | |
|---|---|---|
| DE | 44 35 339 | 4/1996 |
| DE | 197 15 020 | 10/1998 |
| DE | 10308910 | 9/2004 |
| EP | 281635 | 9/1988 |
| EP | 1138956 | 10/2001 |
| FR | 2683270 | 5/1993 |
| JP | 51-112195 | 3/1976 |
| JP | 5-27308 | 4/1993 |
| JP | 5-240208 | 9/1993 |
| JP | 6-117417 | 4/1994 |
| JP | 2002-317802 | 10/2002 |
| WO | 2004/020840 | 3/2004 |

* cited by examiner

CONTROL DEVICE AND HYDRAULIC PILOT CONTROL

BACKGROUND OF THE INVENTION

The invention relates to a control device for the control of a hydraulic consumer having a hydraulically actuable directional valve in accordance with the description herein. The invention furthermore relates to a hydraulic pilot control device in accordance with the description herein.

Hydraulic control devices having hydraulically actuable directional valves are used inter alia in hydraulic systems of vehicles. A plurality of directional values are expediently interlinked in the form of valve disks in a so-called control block. Using such a hydraulic control device, lifting devices of a lift truck or of an agricultural tractor, loading cranes, the bucket of a wheeled loader or also driving and steering functions of a vehicle are operated hydraulically; in the event of a control regulated by flow requirement (load sensing), individual valve disks have a pressure balance for the control of the hydraulic pressurizing medium flow flowing across the valve.

Mineral oil is usually used as the hydraulic pressure fluid or pressurized medium in industrial hydraulics and mobile hydraulics. However, a water-based pressurized medium is also used for certain areas of application. The term fluid will be used in the following for hydraulic fluids.

A hydraulic control device is known, for example, from DE 197 15 020 A1 Directional valves are arranged in different valve disks for the control of hydraulic consumers. The directional valves have valve pistons for the control of pressurized medium connections and in each case two spring chambers. A control pressure is built up in a spring chamber to actuate the valve piston against the spring bias. The respective control pressure is generated by an electrically actuated pressure control valve. Two respective pressure control valves are provided as pilot control valves for a valve disk. The valve piston can thus be deflected in two mutually oppositely set directions. The electric control of the pressure control valves as a rule takes place by means of an operating element.

In rare cases, electrically controlled pressure control valves fail in that the control piston of the pressure control valve jams and can no longer be electrically actuated. One reason for this can be dirt particles carried along in the fluid flow. If the control piston is just located in the control position at which the output of the pressure control valve is blocked against the control fluid supply port and the tank port, no more control fluid can be displaced out of the corresponding spring chamber of the directional valve. The directional valve is thus blocked in the controlled position and the movement carried out by the hydraulic consumer cannot be stopped. Such a block can also not be released by a counter-control (counter-action) at the operating element whereby the oppositely disposed spring chamber is subjected to control pressure via the corresponding control pressure valve since, as said, not fluid can be displaced from the blocked spring chamber.

DE 103 08 910 A1 deals with a safety valve which is integrated into the supply line of pilot control valves. The described, electromagnetically actuated 3/2 way valve can connect the supply line of the pilot control valves either to a pressurized medium source or to a container. A relief passage from the output port to the spring chamber is provided in the valve disk of the 3/2 way valve. When the magnet is actuated, the relief passage is blocked by the magnetic plunger. When the magnet is not actuated, the relief passage to the spring chamber, and thus to the container, is open, provided that the valve disk does not follow the magnetic plunger. The complex and/or expensive construction is disadvantageous in this valve. Nor can the construction be transmitted easily to pilot control valves formed as pressure reducing valves. In addition, the supply line cannot be relieved if a continuous actuation occurs due to an error in the control electronics of the 3/2 way valve.

SUMMARY OF THE INVENTION

It is the object of the present invention to provide an improved control device for the control of a hydraulic consumer which reliably enables the valve piston of a pilot controlled directional valve to be guided back from an actuation position into a neutral position and which is in particular characterized by a simple, cost-effective design.

This object is satisfied in accordance with the invention by a control device and hydraulic pilot control device having the features herein.

The control device in accordance with the invention for the control of a hydraulic consumer is equipped with a directional valve which has a control pressure chamber and a control slider which is adjustable against the force of a spring by building up a control pressure in the control pressure chamber. A pilot control valve controls the inflow and outflow of control fluid into and out of the control pressure chamber. It is the special feature of the present invention that a relief device is present by which the control fluid can be displaced out of the control pressure chamber while bypassing the pilot control valve.

In this way, the control device in accordance with the invention enables the return of the control slider from the actuated position in a reliable manner. In normal operation, the directional valve can be controlled like a conventional directional valve. On a malfunction of the pilot control valve in which the outflow of control fluid from the control pressure chamber via the pilot control valve is blocked, the control slider can nevertheless be displaced from the actuated position. Such a control device thus has a high operational security. The control slider of the directional valve can be guided back into the neutral position or even actuated into a counter-direction not only on a jamming of the control piston of the pilot control valve, but even on a long-term actuation of the pilot control valve due to an error in its electric control circuit. The control device in accordance with the invention can moreover be realized simply and cost favorably. The bypassing of the pilot control valve can in particular be realized with the help of favorable standard components such as check valves or pressure relief valves.

In accordance with a further aspect of the present invention, a hydraulic pilot control device has a control fluid supply port and at least one pressure control valve which generates a regulated control pressure at a control pressure outlet. A check valve opening toward the control fluid supply port is provided between the control pressure outlet and the control fluid supply port.

Such a pilot control device enables the reliable displacement of control fluid from a control pressure chamber while bypassing the pressure control valve. The operating security of a hydraulic control device can thereby be increased. Such a pilot control device moreover has a particularly simple structure and only requires a few additional components in comparison with a conventional pilot control device.

Further advantageous aspects are set forth herein.

In accordance with a particularly preferred embodiment of the present invention, the relief device includes a relief line and a check valve via which control fluid can be displaced from the control pressure chamber into the relief line. A relief device with a particularly uncomplicated structure is thereby set forth. The behavior of the relief device can be controlled in a simple manner with the aid of a pressure prevailing in the relief line.

The relief line can preferably be connected to a tank via a pressure relief valve. A pressure required for the bypassing of the pilot control valve can thus be set simply at the pressure relief valve. This pressure can furthermore be set independently of the pressure of the control fluid supply line. When the pressure relief valve is actuable manually, a bleeding of the control pressure chambers can be carried out in a simple manner.

In accordance with a further preferred embodiment, the relief line is in fluid communication with a control fluid supply line of the pilot control valve. A control device designed in this manner enables a particularly simple and efficient securing of a control pressure chamber against a blocking of the fluid outflow. In addition, the pressure required for the bypassing of the pilot control valve always corresponds to the supply pressure of the control fluid supply line so that it does not have to be set separately.

The pressure in the relief line can preferably be limited to a value which is as high or higher than the maximum control pressure, i.e. the pressure the pilot control valve can set at a maximum at its outlet. It is thereby ensured that no displacement of control fluid into the relief line takes place on a normal control of the directional valve.

In accordance with a further preferred embodiment, the pressure in the relief line can be restricted to a value which is less than the sum of the maximum control pressure and a pressure corresponding to a biasing force of the spring. The force required for the restoration of the control slider from the actuated position can be applied in this manner by hydraulic action on the control slider, e.g. by pressurizing a control pressure chamber arranged oppositely. If the same pressure is present in both control pressure chambers, the control slider returns to a neutral position with the aid of the springs counteracting its deflection.

If the relief line can be relieved by a switching valve to a tank, the control slider returns to its neutral position without any further measures and very rapidly. It can even be deflected in an opposite direction by pressurizing of a control pressure chamber arranged oppositely.

The directional valve preferably has two control pressure chambers through which the control slider can be acted on in mutually opposite directions. Furthermore, control fluid can be displaced into two different branches of the relief line from the two control pressure chambers via a separate check valve, the two different branches of the relief line are fluidly separately from one another, and two switching valves are present via which the branches of the relief line can be relieved to a tank separately from one another. The different branches of the relief line and thus the connected control pressure chambers can thereby be relieved independently of one another in the event of a defect of the pilot control valve. This is an important requirement for the realization of a safe drive which allows a hydraulic motor not only to be stopped on a defect of the pilot control valve, but also to carry out a withdrawal movement. A defective pilot control valve can in particular be bypassed or the one control pressure chamber can be relieved and the oppositely arranged control pressure chamber can be pressurized by a further pilot control valve so that a hydraulic motor controlled by the directional valve carries out a withdrawal movement.

Control fluid from two different branches of the relief line can preferably be supplied to a pressure relief valve via a respective check valve which opens toward the pressure relief valve. Oppositely arranged control pressure chambers of the directional valve can thus be secured against a blocking of the pilot control valves by a simple, efficient design of the control device. In addition, control fluid can be displaced from a control pressure chamber whose pilot control valve fails by pressurizing an oppositely disposed control pressure chamber. It is thus possible to stop a hydraulic consumer by an opposite control at the operating element on a failure of a pilot control valve. The branches of the relief line can moreover additionally be relieved separately from one another, e.g. by a switching valve, so that a withdrawal movement of a hydraulic motor can be carried out despite a defect of the pilot control valve.

A plurality of directional valves are preferably provided, with control fluid being able to be displaced from each control pressure chamber of the different directional valves via a respective separate check valve into a relief line or a branch of the relief line. The control pressure chambers can thus also be secured against a failure of the pilot control valves for a plurality of directional valves.

BRIEF DESCRIPTION OF THE DRAWINGS

The present invention and its advantages will be explained in more detail in the following with reference to the embodiments shown in the Figures.

There are shown.

DESCRIPTION OF THE PREFERRED EMBODIMENTS

The present invention will now be described with respect to FIG. 1 with reference to a directional valve disk such as is used in a hydraulic control block. The invention is, however, not restricted to this specific construction of a hydraulic control device, but can rather be used in hydraulic control devices of almost any construction.

Figure 1:
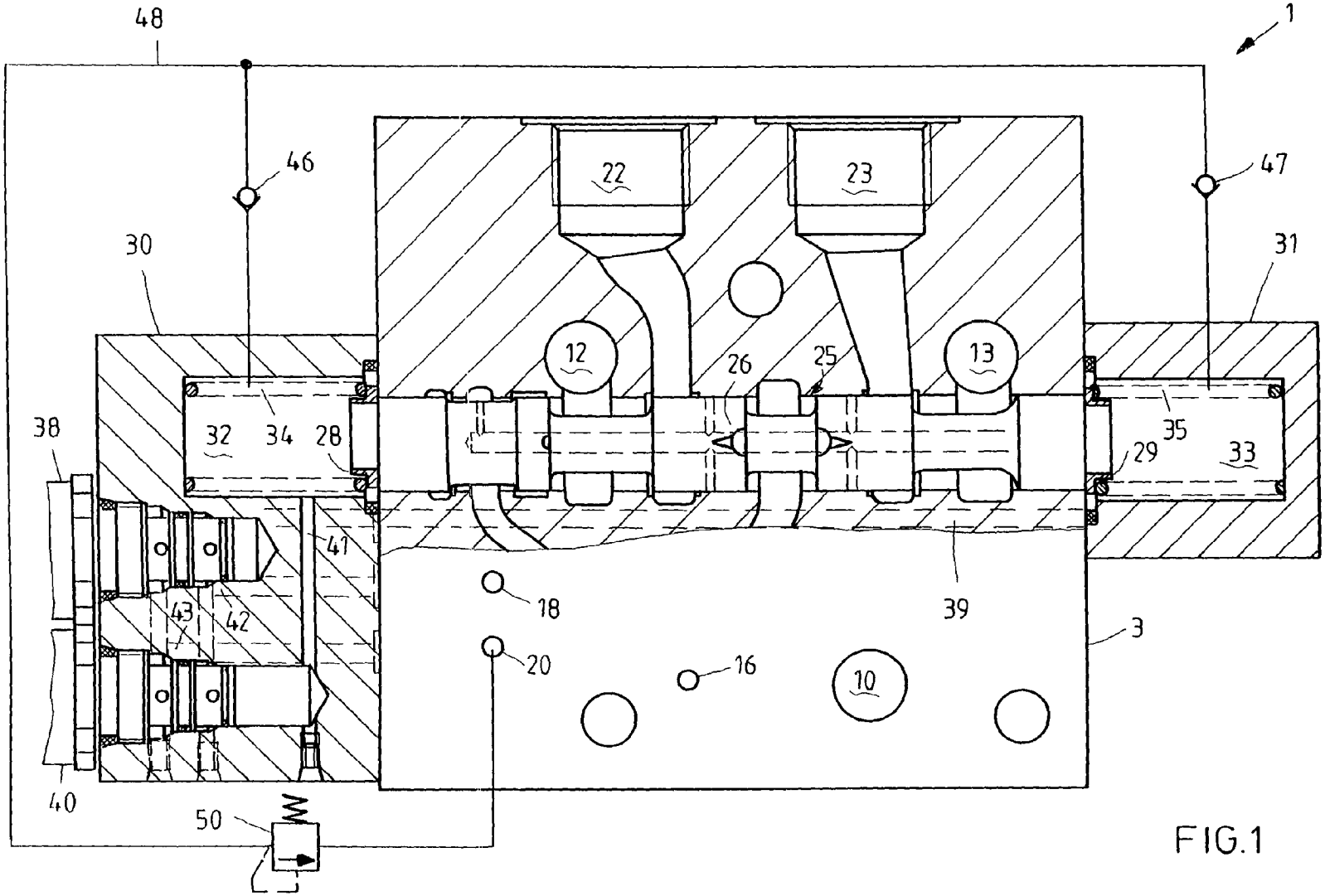
FIG. 1 a side view of a directional valve disk of a hydraulic control block—partly as a cross-section—with an additional fluid line via which control fluid can be displaced from the control pressure chambers.

The valve disk 1 shown in FIG. 1 has a base body 3 with a valve bore 25 within which a control slider 26 is movably guided. Different control edges are formed by the valve bore 25 and the control slider 26 via which fluid connections between a fluid supply port 10 and the ports 22, 23 for a hydraulic consumer can be controlled. Connections between the consumer ports 22, 23 and tank ports 12, 13 can equally be controlled.

The valve disk shown is made in the load sensing technique. The load pressure applied at the consumer ports 22 and 23 is thus detected and supplied to a load pressure report line 16. The details of the load sensing technique are not relevant to the present invention and will therefore not be described in more detail. The load sensing technique is, however, familiar to the person skilled in the art.

The valve 25 is covered to the right side and to the left side of the base body 3 by control covers 30, 31. Spring chambers 32 and 33 are formed in the control covers 30, 31 and a respective biased spring 34 and 35 are located in them. The springs 34, 35 are supported at the base body 3 via spring plates 28, 29. The control slider 26 is centered in a middle position by the effect of the biased springs 34, 35 and of the spring plates 28, 29.

The spring chambers 32, 33 moreover form pressure control chambers which can be acted on by a control pressure. Due to the control pressure acting in a spring chamber—e.g. 32—the control slider 26 experiences a force in the direction of the other spring chamber—e.g. 33—against the bias of the spring 35 arranged therein. If the force exerted onto the control slider 26 by the control pressure overcomes the bias of the spring 35, the control slider 26 moves out of its centered position.

Pressure control valves 38 and 40 are moreover inserted into the control cover 30 attached to the valve disk 1 at the left hand side. The pressure control valves 38, 40 are both connected to a control fluid supply line 18 via the fluid passage 42. A further fluid passage 43 connects the pressure control valves 38, 40 to a control fluid return line 20.

The pressure control valve 38 can be actuated via an electromagnet (not shown) and generates a control pressure proportional to the magnetic force at its outlet. The control pressure generated by the pressure control valve 38 is propagated into the spring chamber 33 via a fluid passage 39. This control pressure effects a force directed to the left at the control slider 26. The pressure control valve 40 likewise equipped with an electromagnet is in communication with the spring chamber 32 via the fluid passage 41. The control pressure generated by the pressure control valve 40 is thus applied in the spring chamber 32 and effects a force directed to the right at the control slider.

Furthermore, the spring chamber 32 is connected to a check valve 46 which opens toward a fluid line 48. A check valve 47 is likewise connected to the spring chamber 33 and opens toward the fluid line 48. The fluid line 48 leads to a fluid tank via a pressure relief valve 50. In the directional valve disk shown, this is expediently brought about by connection to the control fluid return line 20. The outlet of the pressure relief valve 50 can, however, equally be connected to a leakage oil port or to another fluid return line. The pressure relief valve 50 is set to a pressure which corresponds at least to the control pressure which can be generated at a maximum by the pressure control valves 38, 40.

The pressure control valves 38, 40 each have a control piston which allows control fluid to flow out of the control fluid supply line 18 into the respective spring chamber 32 and 33 respectively until the pressure preset by the magnetic force is reached. If the pressure in the spring chamber is higher than this preset pressure, the control piston allows control fluid to flow out into the control fluid return line 20 via the respective pressure control valve 38, 40.

The control piston has a positive excess coverage with respect to the valve housing of the pressure control valve 38 or 40. This means that once the preset pressure in the spring chamber is reached, the spring chamber is blocked both with respect to the control fluid supply line 18 and with respect to the control fluid return line 20. If the control piston acts as a block in such a control position, no more control fluid can flow out of the corresponding spring chamber via the pressure control valve.

The case will be looked at as an example that the control slider 26 is deflected to the right out of the centered position due to the pressure prevailing in the spring chamber 32. If the pressure control valve 40 now acts as a block so that no more control fluid can flow out of the spring chamber 32, the control slider 26 first maintains the deflected position. As soon as the pressure in the spring chamber 32 is increased by an actuation of the control slider 26 directed to the left to a pressure which corresponds at least to the pressure set at the pressure relief valve 50, control fluid flows via the check valve 46 while bypassing the pressure control valve 40 into the fluid line 48 and via the pressure relief valve 50 to the tank. It is thus possible to guide the control slider 26 back into a centered position despite the blocked pressure control valve 40. Since the pressure set at the pressure relief valve 50 is above the highest control pressure which the pressure control valves 38, 40 can generate, no impairment of normal operation is present.

The actuation of the control slider 26 directed to the left, for the bypassing of the blocked pressure control valve 40, can in particular take place by pressurizing the spring chamber 33. A machine operator who notices that the pressure control valve 40 is acting as a block—for instance because the hydraulic consumer has not stopped despite a terminated operating procedure—can counteract this at the operating element. The pressure control valve 38 thereby generates a control pressure in the spring chamber 33 and effects a force onto the control slider 26 directed to the left. In addition, a force acts on the part of the spring 35 which corresponds to the control pressure generated in the spring chamber 32 before the blocking onto the control slider 26 deflected to the right. The force exerted by the spring 35 corresponds, however, at least to the spring bias.

If the pressure in the spring chamber 32 reaches a value—due to the stress of the spring 35 and the control pressure in the spring chamber 33—which corresponds at least to the pressure set at the pressure relief valve 50, the control fluid in the spring chamber 32 flows out via the return valve 46 and the pressure relief valve 50. The control slider 26 thus returns to the centered position.

So that the displacement of the control fluid from the spring chamber 32 is possible by pressurizing the spring chamber 33, the pressure set at the pressure relief valve 50 may at most correspond to the sum of the pressure equivalent of the spring bias and the maximum control pressure which can be generated. A slightly deflected control slider 26 can then also be guided back via the check valve 46 while displacing control fluid and the pressure relief valve 50 into the centered position.

Common pressure control valves are able to generate a control pressure of 30 bar. The bias of the springs 34 and 35 which center the control slider 26 in each case corresponds to a pressure of 5 bar which acts on the side surface of the control slider 26. The pressure relief valve 50 is accordingly preferably set to a pressure between 32 bar and 35 bar. In this manner, the control slider 36 can be reliably guided back to the centered position, even when the valves 38, 40 generating the control pressure act in a blocking manner. The return of the control slider 26 is possible without any mechanical intervention into the valve disk 1—solely by hydraulic actuation.

The mechanisms described for the displacement of control fluid from the left spring chamber 32 naturally also apply in an analog manner to the right hand spring chamber 33, in particular with respect to a displacement of control fluid via the check valve 47 and the pressure relief valve 50.

In the example described, an unwanted deflection of the control slider 26 is corrected by means of an opposite actuation by the machine operator. A return of the control slider while bypassing a pilot control valve can, however, also be carried out by an automatic electronic control. The position of the control slider 26 is first detected for this purpose. If the control slider 26 does not return to the centered position, although no desired pressure is applied at any of the pressure control valves, the electronic control acts on the control slider 26 in a direction opposed to its deflection by actuation of a pressure control valve. A blocked pressure control valve can be bypassed by the fluid line 48 in this context.

Instead of detecting the position of the control slider 26, a conclusion can also be drawn on the position of the control slider 26 by detection of the operating state such as a rotational speed.

A pilot controlled directional valve can also be hydraulically actuated via a pilot control valve designed as a directional valve instead of via two pressure control valves 38, 40. If, in accordance with the invention, a fluid line is provided via which control fluid can be displaced from the control pressure chambers while bypassing the pilot control valve, the control slider of the pilot controlled valve can also be guided back from an actuated position on a displacement of the pilot control valve. The pressure required for this can be built up e.g. by manual actuation. Alternatively, a hydraulic emergency actuation of the control slider can be provided.

Figure 2:
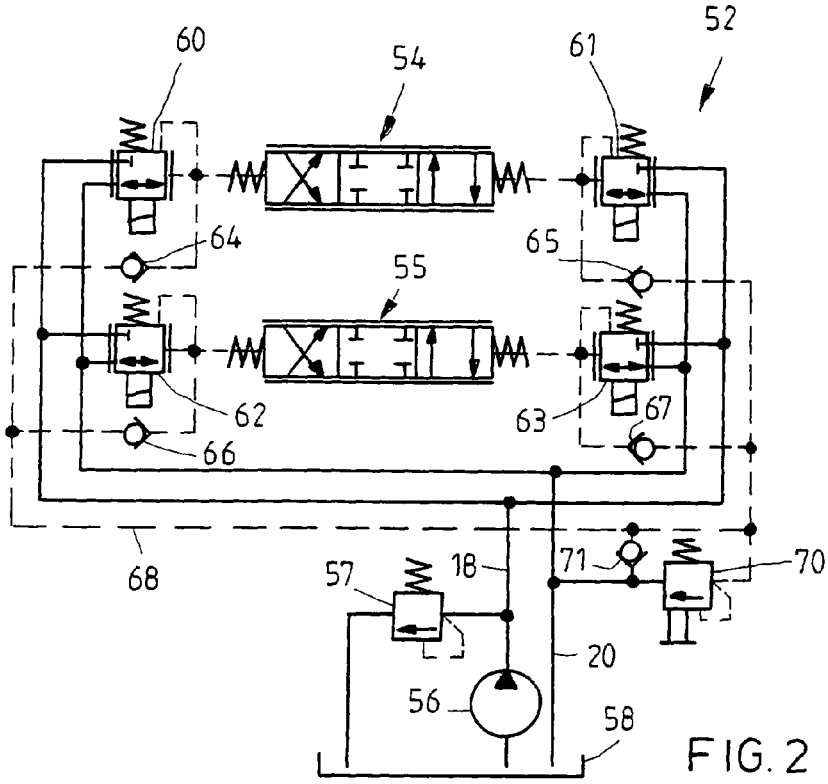
FIG. 2 a diagram of a hydraulic control device having two directional valves which are secured against a blocking of the fluid outflow from the control pressure chambers in the manner shown in FIG. 1 and which additionally have a manually actuable bleeding function.

FIG. 2 shows the diagram of a hydraulic control device 52 which is equipped with two constantly adjustable pilot controlled directional valves 54 and 55 for the control of hydraulic consumers. The directional valves 54 and 55 can have an analog construction to the directional valve disk shown in FIG. 1. The respective control sliders of the directional valves 54 and 55 are centered by springs. An electrically actuated pressure control valve 60, 61, 62 and 63 is connected in each case to the control pressure chambers (not shown) of the directional valves 54 and 55 for the generation of a preset control pressure. The pressure control valves 60, 61, 62 and 63 are supplied with a control fluid via a control fluid supply line 18. The control fluid supply pressure is built up by a pump 56 and is fixed by the pressure relief valve 57. Furthermore, a control fluid return line 20 is connected to each pressure control valve 60, 61, 62, 63 to guide control fluid back to a tank 58.

The control pressure chambers of each directional valve are connected to a fluid line 68 via a respective return valve 64, 65, 66 and 67. The return valves 64, 65, 66 and 67 open in the direction of the fluid line 68. The fluid line 68 leads to the tank via a pressure relief valve 70. The pressure relief valve 70 can be opened by manual actuation. An anticavitation valve 71 is connected parallel to the pressure relief valve 70 and opens toward the fluid line 68. The anticavitation valve 71 can also be integrated into the pressure relief valve 70.

The functional principle of the control device shown in FIG. 2 substantially corresponds to the functional principle of the control device shown in FIG. 1 which was expanded to two directional valves.

Control fluid can be displaced from each control pressure chamber of the two directional valves 54 and 55 at a pressure, which corresponds to the response pressure of the pressure control valves 70, while bypassing the pressure control valves 60, 61, 62, 63. In this case, the control fluid flows to the tank 58 via the corresponding return valve 64, 65, 66, 67, via the fluid line 68 and the pressure relief valve 70. The response pressure of the pressure relief valve 70 is above the maximum control pressure which can be generated by the pressure control valves 60, 61, 62, 63. The response pressure is moreover not above a pressure which corresponds to the spring bias plus the highest control pressure which can be generated by the pressure control valves 60, 61, 62, 63.

The control slider of each directional valve 54 and 55 can thus be reliably guided back into the spring-centered position even when one of the pressure control valves fails. The return of the control slider can in particular take place by hydraulic actuation.

It is particularly advantageous in the control device shown in FIG. 2 that control fluid can be displaced from every control pressure chamber of the directional valves 54, 55 into a single common fluid line 68. In addition, only one single pressure relief valve 70 is required to secure the control pressure chambers. The control device shown in FIG. 2 can be expanded to further directional valves in a simple manner. Its control pressure chambers are connected to the fluid line 68 via a check valve opening toward the fluid line 68 for security.

The response pressure of the pressure relief valve 70 can be set independently of the supply pressure of the control fluid supply line 18. The control fluid supply line 18 can be set to a higher pressure than the pressure relief valve 70 or to a higher pressure than the highest control pressure which can be generated by the pressure control valves 60, 61, 62, 63 to supply further control fluid consumers or to ensure shorter regulation times.

The control device 52 shown in FIG. 2 additionally makes it possible to bleed the control pressure chambers of the directional valves 54, 55 or the control fluid system in a simple manner. For this purpose, the pressure relief valve 70 can be opened by manual actuation. Control fluid flowing into the control pressure chambers can flow out to the tank 58 without hindrance via the check valves 64, 65, 66, 67 and the open pressure relief valve 70. Trapped air is drained off to the tank 58 together with the control fluid.

Figure 3:
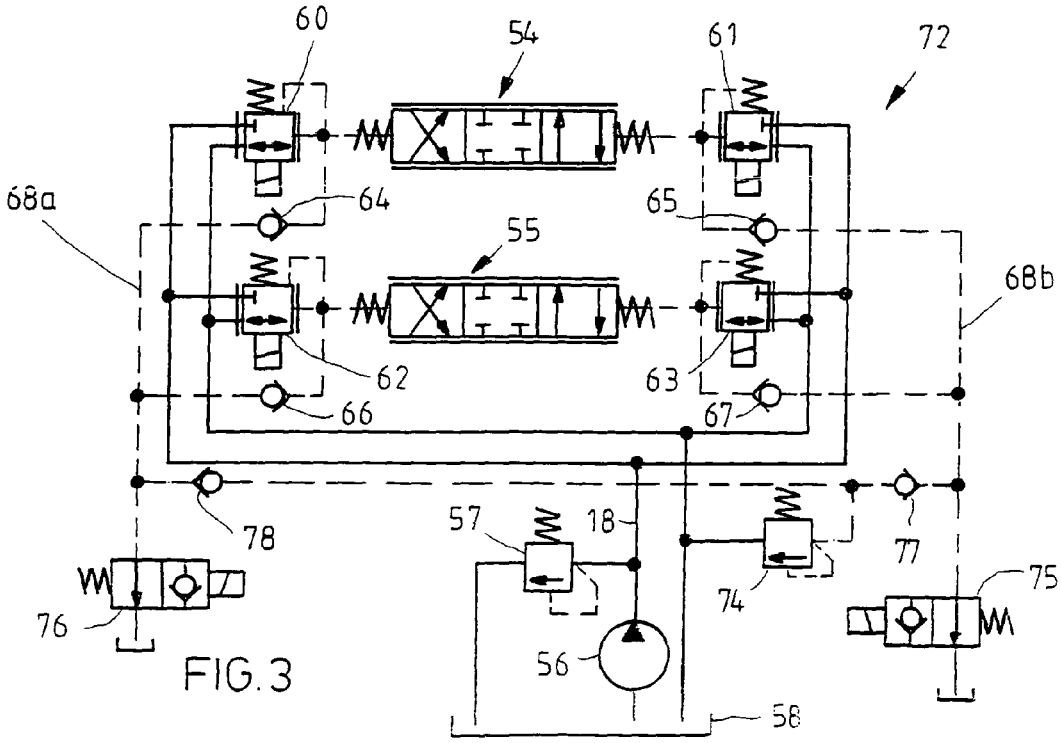
FIG. 3 a diagram of a hydraulic control device having two directional valves and two branches of a relief line which can be relieved by switching valves independently of one another and which can moreover drain off control fluid to the tank via a pressure relief valve.

FIG. 3 represents a diagram of a further hydraulic control device 72. The control device 72 differs from the control device 52 shown in FIG. 2 as shown in the following. In this connection, the same reference numerals are associated with the same components.

The control pressure chambers of the directional valves 54 and 55 are connected via check valves 64, 66 and 65, 67 to two separate branches 68*a* and 68*b* of a fluid line. The fluid line 68*a* and 68*b* serves as a relief line in the case of a defect of one of the pilot control valves 60, 61, 62 and 63. The control pressure chambers of the directional valves 54 and 55 arranged to the left in FIG. 3 are connected to the line branch 68*a* via the check valves 64 and 66. The line branch 68*a* leads, on the one hand, to the pressure relief valve 74 via a further check valve 78. On the other hand, the branch 68*a* can be connected directly to a tank via a switching valve 76. The control pressure chambers arranged at the right in FIG. 3 are connected to the line branch 68*b* via the check valves 65 and 67. Said line branch leads to the pressure relief valve 74 via the check valve 77. A switching valve 75 is moreover present by which the line branch 68*b* can be connected to a tank. The switching valves 75 and 76 are each configured such that they connect the respective line branch 68*a* or 68*b* to the tank in a non-actuated position and interrupt a connection between the line branch 68*a* and 68*b* and the tank in an actuated position.

As in the control device 52 shown in FIG. 2, control fluid can be displaced out of the controlled control pressure chamber of the directional valve 54 via the return vale 64, the line branch 68*a*, the check valve 78 and the pressure relief valve 74 to the tank 58 in the control device 72 in the event of a blockage of a pilot control valve—in the following the pilot control valve 60 as an example. Control fluid can thus be displaced out of the left hand control pressure chamber via the check valve 64 until the control slider has returned to its neutral position by controlling the pilot control valve 61 and by the effect of the restoring springs on the control slider of the directional valve 54.

In addition, the line branches 68*a* and 68*b* can be relieved to the tank independently of one another by the switching valve 75 and 76 respectively. In the normal operating state, the switching valves 75 and 76 are actuated, i.e. they interrupt the connection between the line branches 68*a* and 68*b* and the tank. On a blockage of e.g. the pilot control valve 60, the switching valve 76 can be switched into the non-actuated position so that the line branch 68*a* is pressure relieved. Control fluid can then flow out of the left hand control pressure chamber of the directional valve 54 via the check valve 64 toward the tank. The control slider of the directional valve 54 can thereupon return to its neutral position. When a control pressure is generated by actuation of the pilot control valve in the right hand chamber of the directional valve 54, the control slider can even be deflected beyond the neutral position in the direction of a restriction of the left hand control pressure chamber. This makes it possible not only to stop a hydraulic consumer/motor controlled by the directional valve 54, but also to cause it to carry out a withdrawal or return movement. Important safety demands decisive e.g. for hydraulic driving drives are thereby satisfied.

The fluid separation of the line branches 68*a* and 68*b* by the return valves 77 ad 78 enables the line branches to be relieved independently of one another by the switching valves 75 and 76 respectively. Only in this manner can an actuation of a directional valve 54 or 55 take place for the execution of a withdrawal movement, whereas one of the line branches 68*a* or 68*b* is relieved. In addition, the hydraulic consumer controlled by the directional valve can be stopped by a counter-control (counteraction) at the operating element in every case, even when the switching valves 75 and 76 are left in the actuated position. A changeover valve can also be used for the supply of control fluid from the line branches 68*a* and 68*b* to the pressure relief valve 74 instead of the shown check valves 77 and 78.

On a failure of the control electronics, the switching valves 75 and 76 return into a non-actuated position in which the line branches 68*a* and 68*b* are relieved. The hydraulic consumers controlled by the directional valves 54 and 55 are thereby stopped.

Figure 4:
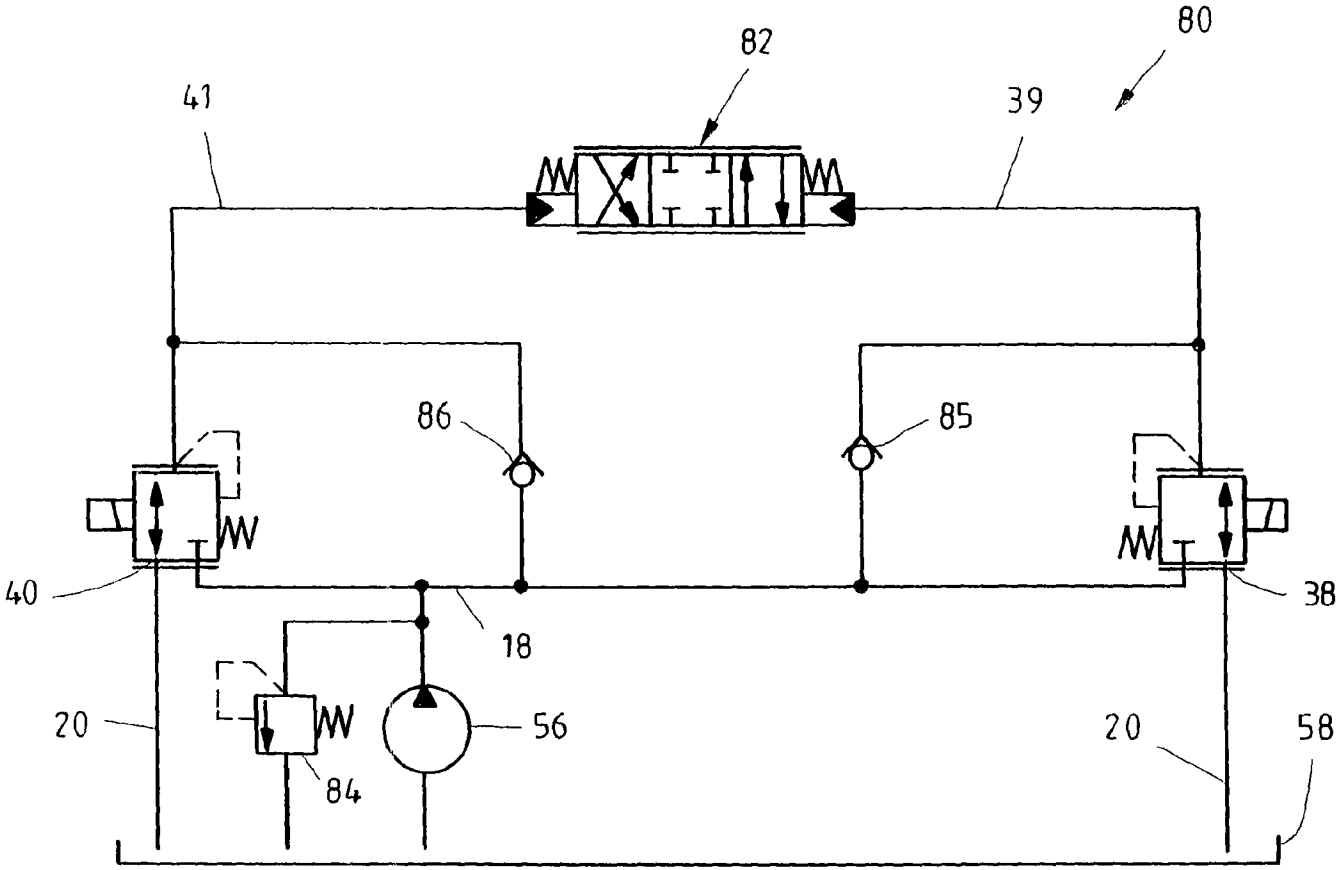
FIG. 4 a diagram of a hydraulic control device in which control fluid can be displaced from the control pressure chambers into the control fluid supply line.

In FIG. 4, a diagram of a further hydraulic control device 80 is shown. The control device 80 is equipped with a pilot controlled, constantly adjustable directional valve 82. The control slider of the directional valve 82 is spring-centered. The hydraulic control of the directional valve 82 takes place by two pressure control valves 38 and 40 which are each connected to a spring chamber of the directional valve 82. A pump 56 ensures the supply of the pressure control valves 38 and 40 with control fluid via the control fluid supply line 18. The pressure in the control fluid supply line 18 is preset by a pressure relief valve 84. The pressure control valves 38 and 40 are connected to the tank 58 via control fluid return lines 20.

A check valve 85 opening toward the control fluid supply line 18 is connected parallel to the pressure control valve 38 between the outlet of the pressure control valve 38 and the control fluid supply line 18. A further check valve 86 is connected parallel to the pressure control valve 40 between its outlet and the control fluid supply line 18. The check valve 86 also opens in the direction of the control fluid supply line 18.

Control fluid can thus be displaced via the check valve 85 into the control pressure supply line 18 from the control pressure chamber connected to the pressure control valve 38. Control fluid can equally be displaced from the control pressure chamber connected to the control pressure valve 40 via the check valve 86 into the control pressure supply line 18.

The pressure required to displace fluid from a control pressure chamber via the check valve 85 or 86 into the control fluid supply line 18 corresponds to the supply pressure of the control fluid supply line 18. The supply pressure is set to the highest control pressure which can be generated by the pressure control valves 38 and 40 or slightly higher. So that the displacement of the fluid from a control pressure chamber by hydraulic action on the control slider is possible on the side of the oppositely disposed control chamber, the supply pressure in the control fluid supply line 18 may not be higher than the sum of a pressure corresponding to the spring bias of the centering springs and the highest control pressure which can be generated by the pressure control valves 38 and 40.

If e.g. the pressure control valve 40 jams and blocks the left hand control chamber of the directional valve 82 while the control slider is deflected to the right, a control pressure can be generated in the right hand control pressure chamber by means of the pressure control valve 38. A pressure which enables the displacement of the control fluid via the check valve 86 into the control fluid supply line 18 arises in the left hand control pressure chamber by the effect of the control pressure generated in the right hand control pressure chamber and by the force of the spring in the right hand spring chamber onto the control slider. The control fluid displaced out of the left hand control pressure chamber either flows via the check valve 84 to the tank 58 or via the pressure control valve 38 into the right hand control pressure chamber.

The control slider of the directional valve 82 can thus also be reliably returned to the centered position on a failure of a pressure control valve. The control device in accordance with FIG. 4 achieves the securing of the control pressure chambers against a blocking of the outflow with a very low effort of additional components. Only check valves 85 and 86 are connected parallel to the pressure control valves 38, 40.

Figure 5:
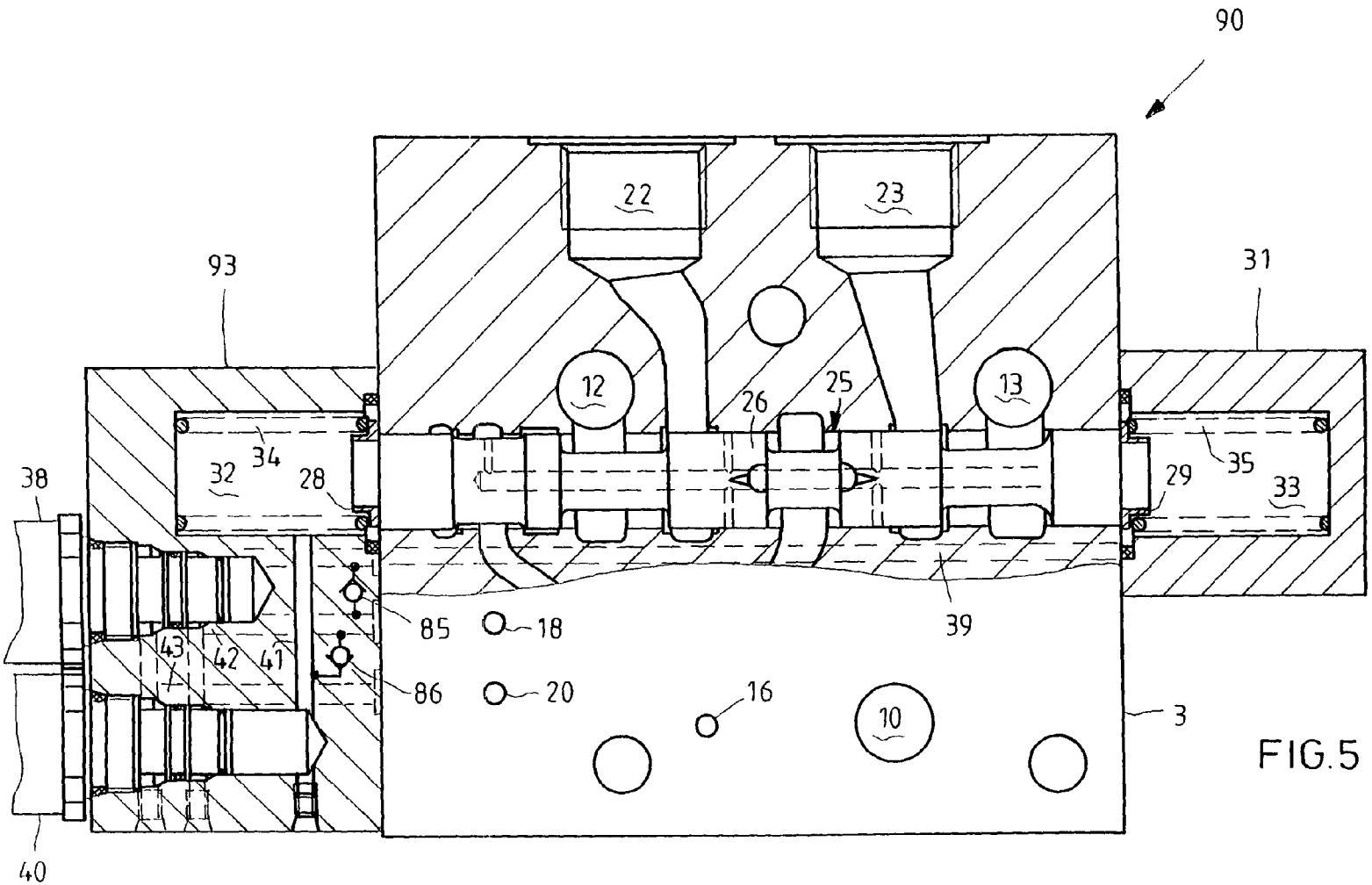
FIG. 5 a side view of a directional valve disk of a hydraulic control block—partly as a cross-section—in an embodiment corresponding to the diagram of FIG. 4.

FIG. 5 represents a valve disk 90 of a control block which has the structure in accordance with the diagram shown in FIG. 4. The structure of the valve disk 90 corresponds in substantial parts to the structure of the valve disk 1 shown in FIG. 1. The same components are provided with the same reference numerals and are not described again in the following.

The base body 3 of the valve disk 90 with its components and ports as well as the right hand control cover 31 in particular correspond to the respective components shown in FIG. 1. The left hand control cover 93 has a spring chamber 32 as a left hand control pressure chamber. The biased spring 34 and the spring plate 28 are located therein. The pressure control valves 38 and 40 are furthermore inserted in the left hand control cover 93. The pressure control valve 40 generates the control pressure in the control pressure chamber 32. The pressure control valve 38 generates the control pressure applied in the control pressure chamber 33. The pressure control valves 38 and 40 are connected to the control fluid supply line 18 or to the control fluid return line 20 via the fluid passages 42 and 43.

The check valves 85 and 86 are additionally arranged in the control cover 93. The check valve 85 leads from the fluid passage 39 connected to the outlet of the pressure control valve 38 to the fluid passage 42 connected to the control fluid supply line 18. It opens in the direction of the control fluid supply line 18. The check valve 86 leads from the outlet of the pressure control valve 40—the fluid passage 41—likewise to the fluid passage 42. The check valve 86 also opens in the direction of the control fluid supply line 18.

A valve disk corresponding to the circuit shown in FIG. 4 can thus be provided in a particularly simple manner. Only the left hand control cover is expanded by two check valves with respect to a conventional valve disk. Although the valve disk 90 has a security against a blocking of the pressure control valves 38 and 40, it only has a slightly more complex structure than a conventional valve disk.

REFERENCE NUMERAL LIST

1 valve disk
3 base body
10 fluid supply port
12 tank port
13 tank port
16 load pressure report line
18 control fluid supply line
20 control fluid return line
22 consumer port
23 consumer port
25 valve bore
26 control slider
28 spring plate
29 spring plate
30 control cover
31 control cover
32 left hand spring chamber/control pressure chamber
33 right hand spring chamber/control pressure chamber
34 spring
35 spring
38 pressure control valve
39 fluid passage
40 pressure control valve
41 fluid passage
42 fluid passage
43 fluid passage
46 check valve
47 check valve
48 fluid line
50 pressure relief valve
52 hydraulic control device
54 constantly adjustable directional valve
55 constantly adjustable directional valve
56 pump
57 pressure relief valve
60 pressure control valve
61 pressure control valve
62 pressure control valve
63 pressure control valve
64 check valve
65 check valve
66 check valve
67 check valve
68 fluid line
68*a* fluid line branch
68*b* fluid line branch
70 pressure relief valve with manual actuation
71 anticavitation valve
72 hydraulic control device
74 pressure relief valve
75 switching valve
76 switching valve
77 check valve
78 check valve
80 hydraulic control device
82 directional valve
84 pressure relief valve
85 check valve
86 check valve
90 valve disk
93 control cover

The invention claimed is:

1. A control device for the control of a hydraulic consumer comprising a directional valve (1; 54; 90) which has a control pressure chamber (32) and a control slider (26) which is adjustable against the force of a spring (35) by building up a control pressure in the control pressure chamber (32) and comprising a pilot control valve (40; 60) for the control of the inflow and outflow of control fluid into and out of the control pressure chamber (32), wherein a relief device (46, 48, 50; 68*a*, 76; 86) is present by which the control fluid can be displaced from the control pressure chamber (32) while bypassing the pilot control valve (40; 60) in a condition when the pilot control valve (40; 60) is blocked, the relief device includes a relief line (48) communicating with a fluid tank, a pressure relief valve (50) situated therein and a check valve (46) via which control fluid can be displaced from the control pressure chamber (32) into the relief line (48), and the pressure in the pressure relief valve (50) is restricted to a value which is as high or higher than the maximum control pressure in the pilot control valve (40;60), such that upon occurrence of the condition when the pilot control valve (40;60) is blocked against further displacement of fluid from the control pressure chamber (32), the control slider (26) is guided back into a centered position despite blocking of the control valve (40; 60).

2. A control device in accordance with claim 1, wherein the pressure in the relief line (48) can be restricted to a value which is lower than the sum of the maximum control pressure and a pressure corresponding to a bias force of the spring (35).

3. A control device in accordance with claim 1, wherein control fluid can be supplied from two different branches (68*a*, 68*b*) of the relief line to the pressure relief valve (74) via a respective check valve (77, 78) which opens toward the pressure relief valve (74).

4. A control device in accordance with claim 1, wherein a plurality of directional valves (54, 55) respectively having at least one control pressure chamber are provided; and control fluid can be displaced from each of the control pressure chambers of the different directional valves (54, 55) via a respective separate check valve (64, 66) into the relief line (68) or a branch of the relief line (68*a*, 68*b*).

5. A control device in accordance with claim 1, wherein the pressure relief valve (70) can be actuated manually to exert a bleeding function.

6. A control device in accordance with claim 5, wherein the pressure in the relief line (48) can be restricted to a value which is lower than the sum of the maximum control pressure and a pressure corresponding to a bias force of the spring (35).

7. A control device in accordance with claim 1, wherein the relief line is in fluid communication with a control fluid supply line (18) of the pilot control valve (38, 40).

8. A control device in accordance with claim 7, wherein the pressure in the relief line (48) can be restricted to a value which is lower than the sum of the maximum control pressure and a pressure corresponding to a bias force of the spring (35).

9. A control device in accordance with claim 1, wherein the directional valve (1) comprises a base body (3) in turn having a valve bore (25) in which the control slider (26) is movably guided, said control pressure chamber (32) comprises a pair of spring chambers (32, 33) situated at opposite ends of said valve bore (25), a pair of springs (34, 35), each said spring situated in a respective one of said pair of spring chambers (32, 33), and said springs (34, 35) arranged to bias said control slider (26) to the centered position in said directional valve (1), said relief line (48) communicating with both said spring chambers (32, 33), and a pair of check valves (46, 47), each said check valve situated in said relief line for displacing fluid into the relief line (48) from a respective one of said spring chambers (32, 33).

10. A control device in accordance with claim 9, comprising a pair of piston-operated pressure control valves (38, 40), a control fluid supply line (18) through which each of said pressure control valves (38, 40) communicates with a respective one of said spring chambers (32, 33), and a control fluid return line (20) arranged to direct fluid flow out of a respective one of said spring chambers (32, 33) when a preset pressure in reached.

11. A control device in accordance with claim 1, wherein the relief line (68*a*) can be relieved into a tank by a switching valve (76).

12. A control device in accordance with claim 11, wherein the directional valve (54) has two control pressure chambers by which the control slider can be acted on in mutually opposite directions; control fluid can be displaced from the two control pressure chambers via a respective separate check valve (64, 65) into two different branches (68*a*, 68*b*); the two different branches (68*a*, 68*b*) of the relief line are fluidly separated from one another; and two switching valves (75, 76) are present via which the branches (68*a*, 68*b*) of the relief line can be relieved to a tank independently of one another.

13. A control device in accordance with claim 12, wherein control fluid can be supplied from the two different branches (68*a*, 68*b*) of the relief line to the pressure relief valve (74) via a respective check valve (77, 78) which opens toward the pressure relief valve (74).

* * * * *